US006468119B1

(12) United States Patent
Hasl et al.

(10) Patent No.: US 6,468,119 B1
(45) Date of Patent: Oct. 22, 2002

(54) COMPOSITE STERN DRIVE ASSEMBLY

(75) Inventors: Emil Hasl; Cedric Savineau; Matt Wilkins; Chris Savoie, all of Virginia Beach, VA (US); Jeff Hardesty, Moyock, NC (US); Mark Skrzypek, Chesapeake, VA (US); Rickard Holmberg, Gothenburg (SE)

(73) Assignee: AB Volvo Penta (SE)

( * ) Notice: Subject to any disclaimer, the term of this patent is extended or adjusted under 35 U.S.C. 154(b) by 0 days.

(21) Appl. No.: 09/683,043

(22) Filed: Nov. 12, 2001

(51) Int. Cl.[7] ..... B63H 5/125
(52) U.S. Cl. ..... 440/57; 440/76
(58) Field of Search ..... 440/53, 57, 61, 440/76, 77

(56) References Cited

U.S. PATENT DOCUMENTS 4,957,461 A * 9/1990 Nakayama ..... 204/196.17
5,178,566 A * 1/1993 Stojkov et al. ..... 440/75
6,206,739 B1 * 3/2001 Dadd et al. ..... 440/75

* cited by examiner

*Primary Examiner*—Jesus D. Sotelo
(74) *Attorney, Agent, or Firm*—Howrey Simon Arnold & White LLP

(57) ABSTRACT

Stern drive assembly configured for utilization in an inboard/outboard power plant for a boat. The stern drive assembly includes a central rigid core that is configured at an upper portion to be coupled to the stern of a carrying boat. A lower portion of the core is designed to accept a boat-moving force generated by a water propulsion unit that is coupled thereto. A thin-walled housing is configured to be secured about a predominance of the centrally located rigid core. The housing has an outer surface that establishes an exterior of the stern drive assembly and an inner surface directed generally toward the central rigid core. A portion of an exterior surface of the central rigid core is configured to cooperate with a corresponding portion of the inner surface of the thin-walled housing. These two portions, when in cooperative orientation one with the other, form a functional feature for the stern drive assembly.

49 Claims, 13 Drawing Sheets

COMPOSITE STERN DRIVE ASSEMBLY

BACKGROUND OF INVENTION

1. Field of the Invention

The invention is directed generally to marine engine drive systems designed to supply rotary power down from an engine carried on a boat to a submerged propeller and for imparting the propelling force generated by the rotating propeller in the water back to the boat thereby causing the boat to travel across the water. More particularly, the invention relates to a clam shell-style composite housing fixed about a core drive frame member.

2. Background

Traditionally, powerboats have been powered with either an inboard engine, an outboard engine, or an inboard/outboard engine. In the inboard configuration, the engine is typically positioned within an engine compartment or engine room that is carried on the boat. A drive shaft of the assembly extends through a bottom surface of the hull of the boat with a propeller positioned thereupon, but exteriorly to the boat. The drive shaft and propeller remain in the water during normal operation of the boat and typically cannot be removed from the water unless the boat is also taken out of the water. Often, an inboard engine is completely concealed within the engine compartment or engine room below the deck of the boat.

An outboard engine is a self contained unit that is most often attached to the transom of a boat. A typical outboard engine configuration includes an engine that is completely concealed within a cowling, at least one propeller attached to a lower unit, and a drive shaft contained within a drive shaft housing that extends in a generally vertical direction between the engine and the lower unit. The lower unit is typically constructed as a one piece body that is made of aluminum. Further, the lower unit contains gears for transferring torque produced by the engine, and imparted on the drive shaft, to a propeller shaft that is generally oriented perpendicularly to the drive shaft. The lower unit includes a skeg for steering purposes, an anti-cavitation plate, and a cylindrical bore that houses a forward gear, a reverse gear, and a propeller shaft. The lower unit usually also includes water intake ports for receiving raw water that is used to cool the engine. Further, the lower unit is coupled to a drive shaft housing, or upper housing, using a set of five to ten bolts.

Most outboard engines manufactured today further include a tilt/trim system that enables the outboard engine to be tilted through various angles to improve the performance of a boat and to rotate the lower end of the power plant out of the water. Generally, outboard engines can be trimmed between angles relative to a vertical axis of about minus 5 degrees to about plus 15 degrees and can be tilted through a range of angles between 15 degrees and about 60 degrees. The trim/tilt system generally is composed of three hydraulic cylinders, one cylinder that is the tilt mechanism and two cylinders that combine with the tilt cylinder to form a trim mechanism. The trim range includes a range of angles within which an engine can be operated to power the carrying boat while a tilt range includes a range of angles within which the engine generally will not be operated to power the boat; that is, the tilt range is for use when the engine is not running. The trim function moves the engine through the described range of angles about half as fast as the tilt function moves the engine because trim adjustment is used to adjust the drive leg through the trim range of angles when the boat is traveling, often at relatively high rates of speeds. Further, the trim feature operates at this reduced speed for safety concerns since relatively small trim adjustments can significantly affect the attitude of the boat. It also permits an operator to fine tune the travel position of the boat as it travels across the water for enhanced performance.

The tilt mechanism typically enables an entire outboard engine, or substantially all of the engine, to be tilted out of the water while the boat remains in the water. This feature is advantageous for many reasons. It is used during the boat launch and the retrieval process to protect the drive unit, and particularly the lower end from damaging strikes. Even if the boat is not removed from the water, the positioning of the drive leg outside the water using the tilt function prevents aquatic growth, such as algae, barnacles, and other marine plants and animals, from developing on the lower unit. Water, and especially salt water, can be highly corrosive. Salt water corrodes metals and provides a prime environment for galvanic reactions that accelerate decay of metals. Thus, removing the drive assembly from the water when not in use can increase its life dramatically.

The inboard/outboard engine configuration is a hybrid between the inboard and the outboard engine configuration just as the name implies. The inboard/outboard engine configuration generally includes a motor that is positioned within an engine compartment, much like the inboard engine configuration. Unlike the inboard engine which may be located mid-ship, however, the inboard/outboard engine compartment is typically located proximate the transom of the boat. The inboard/outboard engine further includes a drive assembly resembling the lower unit of an outboard engine. The drive assembly of an inboard/outboard power plant, however, is not coupled to a drive housing as described above relative to outboard engines. Instead, the drive assembly includes a shield assembly that is coupled to the transom of a boat.

The drive assembly of the inboard/outboard engine further includes a tilt/trim assembly that has a function similar to the tilt/trim assemblies found on outboard engines and described above. The conventional tilt/trim assemblies for inboard/outboard engines, however, are usually designed differently than those for outboard engines. Specifically, the conventional inboard/outboard tilt/trim assemblies include two hydraulic cylinders. One hydraulic cylinder is attached to one side of the drive assembly proximate the cavitation plate and the other hydraulic cylinder is attached to the other side of the assembly near the cavitation plate. Each cylinder is oriented generally parallel to the cavitation plate. With the hydraulic trim cylinders attached in this fashion, the cylinders produce unwanted water spray during operation of the engine while the boat is traveling on plane. Specifically, as the boat is planing, water travels on top of the cavitation plate and contacts the hydraulic cylinders near where they are attached to the drive assembly. The water is deflected and forms a spray that is unattractive and can cause the back portion of a boat to become wet, including any nearby passengers.

Though there are some drawbacks to traditional inboard/outboard designs, the design still possesses attributes that make it highly desired by many boaters. For instance, inboard/outboard engines can include a closed-loop water cooling system that uses recirculated cooling fluid. This closed-loop system eliminates corrosion problems associated with using raw salt water as encountered in outboard engine. Because a closed-loop cooling system weighs significantly more than a raw water cooling system, typical outboard motors do not have closed-loop water cooling systems. Further, the inboard/outboard engine is usually quieter than most outboard engines and thus desired by some boaters. Additionally, the low profile of inboard/outboard power plants do not provide an obstacle at the transom of the boat, such as the obstacle produced by the elevated engine portion of an outboard power plant. Instead, a relatively unobstructed transom is presented by the low-rise inboard/outboard power plant. As a result, inboard/outboard engines allow boats to include unobstructed swim platforms that extend across the entire transom of a boat which is something that is not normally possible when using an outboard engine. Thus, these and other attributes not mentioned make an inboard/outboard engine the desired engine for many boating applications.

As indicated above, the inboard/outboard engine has a number of disadvantages. In contrast to the outboard engine and the inboard engine, the inboard/outboard engine exposes more parts to the harsh environment of salt water. As mentioned above, the outboard engine is self-contained and is capable of being tilted completely out of the water using the trim mechanism. Further, the inboard engine has only a drive shaft and a propeller that are exposed to the water. The inboard/outboard, on the other hand, cannot usually be rotated completely out of the water when the boat is floating. Thus, anytime the boat remains in the water, the drive assembly at least partly remains in the water. Still further, the inboard/outboard engine has additional parts, such as the shield assembly, exhaust tubes, oil hoses, shift rods, covering sheaths, and a gimbal ring, that are exposed to the water, and are thus also subject to corrosion. As a result, these additional parts that are exposed to the water increase the need for service and increase the potential for breakage.

As described above, both outboard engines and inboard/outboard engines have lower units that transfer torque from a generally vertical drive shaft to a propeller drive shaft that is generally perpendicular to the vertical drive shaft. The lower unit typically contains a skeg, a lower chamber capable of receiving gears, bearings and the propeller drive shaft, one or more raw water intake ports that are connected to a raw water chamber and conduit system, and an anti-cavitation plate. Generally, the lower unit is a unitary member that is constructed of aluminum and formed by die-casting. The lower unit is composed of aluminum to withstand heavy blows caused by hitting submerged objects, such as logs, pilings and other debris, and from running aground. Further, the lower unit has been constructed of aluminum to handle the forces generated by the moment arm produced by the propulsion unit, most typically in the form of a rotating propeller, acting at the bottom of the lower unit. It is the lower unit coupled with either a drive housing or a shield assembly that provides the structural integrity of a typical drive system. Additionally, the lower unit is desirably designed to present an exterior surface that allows the drive system to move through water with a minimized hydrodynamic drag.

In addition to providing a hydrodynamically efficient exterior shape, lower units of traditional stern drives have included raw water intake ports and conduits, and exhaust conduits. The common designs for the raw water and exhaust conduits have been inefficient and susceptible to corrosion. More specifically, the conduits are inefficient flow conveyances because their configuration has previously been dictated by the die-cast manufacturing processes for these substantially solid, or thick-walled bodies. That is, the conduits or channels were conventionally formed between the outside surfaces of the exterior walls of the lower unit and the interior walls that formed the central cavity provided to receive a drive shaft therein. In other words, traditional service conduits have been formed in the wall's thickness of the lower unit. Still further, the conduits are often formed as right angle channels, or near right angle channels and resultingly include corner spaces at these right angle turns where eddies form and other flow restricting phenomena occur. Additionally, when the drive assembly is used in salt water, these areas are prone to collecting salt which accelerates corrosion. While this problem is well known, simply adding more material to eliminate these places of poor flow is not the answer because this simply adds more weight to an already over weight machine.

The bifurcated upper unit/lower unit design is problematic in its own right. For instance, the joint between the two units requires a seal that frequently corrodes and leaks. Further, while the lower unit has a raw water unit conduit that is formed from the inside surface of the exterior walls, the raw water conduit located within the upper unit is typically composed of a tubing or pipe. As a result, some structure for connecting the raw water conduit of the lower unit to the raw water conduit of the upper unit must be included. As with all fluid connections, each detrimentally presents a heightened potential for leakage.

Thus, a need exists for a drive assembly for an inboard/outboard or an outboard engine that resists corrosion while maintaining or improving the strength and hydrodynamic qualities found in conventional drive systems. Further, a need exists for an inboard/outboard engine having a tilt/trim mechanism that does not result in unwanted water spray. As always, there is a constant desire for less complex drive assemblies that are more efficient to manufacture and assemble, and are ultimately more reliable because of their simplicity. Finally, a need exists for an improved cooling and exhaust system for marine engines.

SUMMARY OF INVENTION

Set forth below are summaries of primary aspects of systems and methods configured and practiced according to the presently disclosed inventions. These features address one or more of the foregoing problems, and/or provide further benefits and advantages as will become evident from the included descriptions.

In at least one embodiment, one aspect of the presently disclosed inventions takes the form of a stern drive assembly that is configured for utilization in an inboard/outboard power plant for a boat. The stern drive assembly includes a central rigid core that is configured at an upper portion to be coupled to the stern of a carrying boat. A lower portion of the core is designed to accept a boat-moving force generated by a water propulsion unit that is coupled thereto. The term coupled shall be taken to mean a connection, but not necessarily a direct connection. That is, certain other components may be interstitially located, or connected between, those components that are specified as being coupled, or couplable, together. Water propulsion units take various forms; among others, single and dual rotating propellers are included, as well as marine jet propulsion systems. A thin-walled housing is configured to be secured about a predominance of the centrally located rigid core. In this context, the term predominance should be taken to mean greater than one-half or fifty percent. The housing has an outer surface that establishes an exterior of the stern drive assembly and an inner surface directed generally toward the central rigid core. A portion of an exterior surface of the central rigid core is configured to cooperate with a corresponding portion of the inner surface of the thin-walled housing. These two portions, when in cooperative orientation one with the other, form a functional feature for the stern drive assembly.

One example of such a functional feature is a fluid flow passage that is configured to carry fluids through the stern drive assembly during operation. A special characteristic of at least some of these flow passages is that a part of the passage curvaceously shaped for facilitating fluid flow therethrough. When the walls of such fluid flow passages are curved, as opposed to having sharp turns and corners, the resistance to movement of fluids passing therein is minimized. As specific examples, an individual fluid flow passage may exemplarily be configured as an exhaust channel or a coolant water channel, typically conveying fluids, both gases and liquids, to and/or from the powering engine of the boat.

The thin-walled housing is generally spaced apart from the central rigid core. In this way, a working space is formed between the two components. Preferably, the working space is provided to accommodate location of the functional feature(s), such as an exhaust channel, therein. In at least one example, the working space is maintained by one or more spacing ribs that are abuttingly positioned between the thin-walled housing and the central rigid core. Among the several spacing ribs, at least two are transversely oriented to at least one of the others. That is to say, these two exemplary ribs are not parallel to each other, but are instead positioned at some angle to one another. The angle need not necessarily measure ninety degrees, but does measure some other than zero degrees so that the thin-walled housing is fortified against flexure by the ribs' inclusion. This transverse orientation of the ribs is often a natural consequence of their configuration to form a required functional feature. With respect to the thin-walled housing, the ribs are preferably oriented at approximate right angles to the housing's inner surface.

In a like manner, such functional features can be formed, at least partially, by similarly configured ribs that extend from the central rigid core. In one particularly preferred embodiment, the functional feature, such as an exhaust channel, is formed through a cooperation of ribs that extend from the thin-walled housing and ribs that extend from the central rigid core.

In a preferred construction, the thin-walled housing is formed from at least two clam-shelf style cowlings that are configured for mating engagement along perimeter portions of the shells. An advantageous material of construction is impact resistant, resin and fiber based composite. To promote structural integrity of the housing, the two clam-shell style cowlings are cemented together, and as a unit, form the exterior presentation of the stern drive assembly. Further support is provided to the housing when it is cemented to the central rigid core for substantially permanent fixation together.

In order to affect sufficient structural fortitude while maintaining a necessary degree of flexure, an average composite thickness ranging from about 2 mm to about 10 mm is preferred. In practice, an average composite thickness of about 3 mm has been found to strike an advantageous balance between the desired performance characteristics of durability which requires a certain degree of ductility, and rigidity which is needed for efficient force transmission.

To enhance the performance of the stern drive assembly, the central rigid core is unitarily constructed, preferably from aluminum, thereby forming a monolithic member that extends between the upper and lower portions of the core.

According to another aspect, this invention is directed to a drive assembly for propelling a boat through water by coupling an engine to at least one propeller. This drive assembly replaces the conventional lower unit and its support structure that have traditionally been used in outboard and inboard/outboard power plants.

Specifically, the drive assembly can include, in part, a drive frame extending aft from a transom of a boat with a first cowling covering substantially all of a first side of the drive structure and a second cowling covering substantially all of another side of the drive frame opposite the first side. The cowlings provide, in part, a hydrodynamically efficient exterior shape for the drive frame. The drive frame can include an upper chamber, a middle chamber, and a lower chamber. The upper chamber is sized to receive a clutch assembly having a plurality of gears for transferring rotational motion from a generally horizontal drive shaft coupled to an engine to a generally vertical drive shaft. The middle chamber receives the generally vertical drive shaft, and the lower chamber receives a combination of gears, bearings and a propeller shaft.

The exterior surface of the drive frame may include one or more ribs for attaching the cowlings to the drive frame and for supporting the cowlings. The internal surface of the cowlings can contain laterally extending members configured to mate with the ribs of the drive frame to provide a surface for attaching the cowlings to the drive frame and for supporting the cowlings. Additionally, the perimeter of the cowlings contain a cowling connection system that can exemplarily take the form of a tongue and groove system. For instance, one cowling can have a tongue positioned on the inner surface of its perimeter and the other cowling can have a groove capable of receiving the tongue that is positioned on its inner surface. Alternatively, the cowling connection system can include other connection devices discussed below.

The cowlings establish the outside surfaces of the drive frame and provide the drive frame with a more efficient hydrodynamic exterior surface. Additionally, the cowlings have semi-conduits formed on their internal surfaces that when mated with semi-conduits formed on the exterior surfaces of the drive frame, form completed conduits. These conduits are used, for example, to transport cooling water from the water intake ports located in the cowlings to an engine cooling system. Additionally, such conduits may be used to transport exhaust gases and cooling water from the engine through a plurality of exhaust ports.

In one embodiment, the cowlings can be formed from a composite material. Tests have proven resin and fiber based composite material to be extremely durable and capable of performing exceptionally well in this application. A drive assembly constructed with cowlings manufactured from this material is about 40 pounds lighter than a comparable conventionally designed drive assembly, which correlates to about a 20 percent decrease in weight. Alternatively, the cowlings can be formed from other suitable materials.

The drive system can be assembled using an adhesive, such as an epoxy, that is placed along the perimeter of the cowlings and on the laterally extending members that mate with the ribs. Preferably, the adhesive forms a permanent bond so that once the cowlings are attached to the drive frame and to each other, they cannot be separated. Thus, the cowlings and the drive frame form a monolithic structure. Alternatively, the cowlings can be attached to the drive frame using mechanical connectors such as screws, nuts and bolts.

The drive frame is pivotably coupled to a gimbal ring, thereby enabling the drive frame to rotate about a generally horizontal axis so that the trim and tilt position of the drive assembly can be adjusted. Further, the gimbal ring is pivotably mounted to a shield assembly that allows the gimbal ring, together with the drive frame and attached cowlings, to rotate about a generally vertical axis for steering purposes. In addition, a single trim cylinder is coupled to the drive frame at one end and to the gimbal ring at the other end. Importantly, the single trim cylinder attaches to the drive frame on the side of the drive frame facing the transom of the boat. In this configuration, the single trim cylinder does not come in contact with the moving water as the carrying boat is on plane. Therefore, no water spray is caused by the single trim cylinder.

An advantage of such a drive system is that the system allows for the exterior surface of the drive system to be composed of a non-metallic material. As a result, less metal surface area is exposed to salt water and, thus, there is less corrosion.

Yet another advantage of the new drive system is that it contains thirty percent fewer parts than a comparable conventionally designed drive assembly. This fact is due, at least in part, to the use of an adhesive to couple the assembly together rather than bolts, as used in conventional drive systems. There is also the elimination of the interface between an upper and lower unit. The formation of fluid channels such as raw water conduits and exhaust conduits on the external surface of the drive frame and the internal surfaces of the cowlings is also new.

Another advantage of this system is that the drive frame provides the necessary support for the forces generated by the propeller. While the cowlings provide some support to the drive frame, the majority of the structural support is provided by the drive frame. As a result, the cowlings can be designed without taking this type of structural support into account. Instead, the cowlings are designed to a specification for withstanding leading-edge impacts such as that suffered when an object floating in the water is struck by the submerged portion of the power unit as it slices through the water. Other design features of the cowlings include a minimization of hydrodynamic drag and flow resistance to cooling water and exhaust passing through conveyances for such fluids in the drive assembly. These several features are provided by the invention, all while enclosing and protecting the working parts of the drive assembly.

Yet another advantage of this system is that the raw water conduit formed by the cowlings increases water circulation through an engine water cooling system by about fifty percent.

Still another advantage of this system is that the exhaust conduit formed by the drive frame and the cowlings reduces the back pressure that is typically found in engine systems using conventional drive systems.

Another advantage of this system is that the raw water conduit and the exhaust conduit do not include spaces where eddies can form and salt can accumulate.

Still another advantage of this system is that the exterior shape of the cowlings results in ten percent less hydrodynamic drag than conventional drive assemblies. Further, the cowling generates vertical lifting forces that are translated to the drive assembly and to the boat, thereby enhancing the performance of the boat.

Another advantage of this invention is that the drive assembly includes a single hydraulic trim cylinder for trimming and tilting the engine. This reduces a manufacturer's warranty costs significantly and reduces the number of parts susceptible to failure.

Yet another advantage of this system is that the single hydraulic trim cylinder is coupled to the drive assembly so that it is not in contact with the moving water while the carrying boat is on plane. Therefore, the single hydraulic trim cylinder does not produce undesirable water spray that is typical of hydraulic trim cylinders used with convention inboard/outboard drive cylinders.

These and additional advantages will become evident to those skilled in the art from the drawings and detailed description that is provided herewith.

BRIEF DESCRIPTION OF DRAWINGS

The accompanying drawings, which are incorporated in, and form a part of the specification, illustrate preferred embodiments of the presently disclosed invention(s) and, together with the description, disclose the principles of the invention(s). The several illustrative figures include the following.

DETAILED DESCRIPTION

Figure 1A:
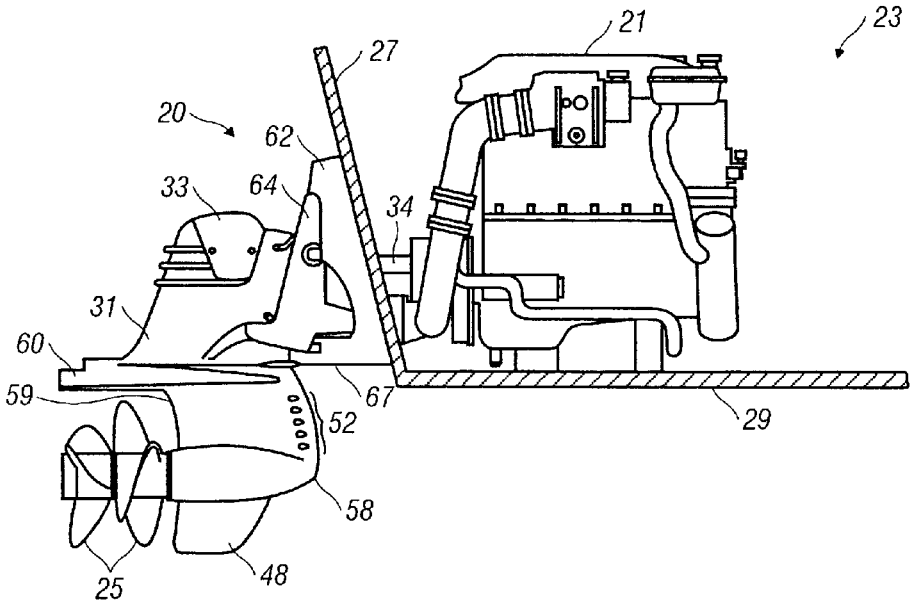
FIG. 1A is a side view of an exemplary marine drive system configured according to the present invention(s) installed upon a boat.

As shown in FIG. 1A, a drive assembly 20 according to a preferred embodiment of the invention is configured to be installed upon a boat 23 proximate to the boat's 23 transom 27 and is coupled between an engine 21 that is mounted to a hull 29 of boat 23 and at least one propeller 25. For the purposes of this invention, engine 21 can be a gasoline engine, a diesel engine, or other mechanical power generating engine. Further, engine 21 can be cooled using an air cooling system, a closed-loop water system, or an open-loop system using water taken from the body of water in which boat 23 floats. In addition, boat 23 is not limited to a particular size, model or application; the drive assembly 20 can be employed across a wide range of boats. Details of the exterior of the drive assembly 20 may be best appreciated in FIG. 1B.

Figure 2:
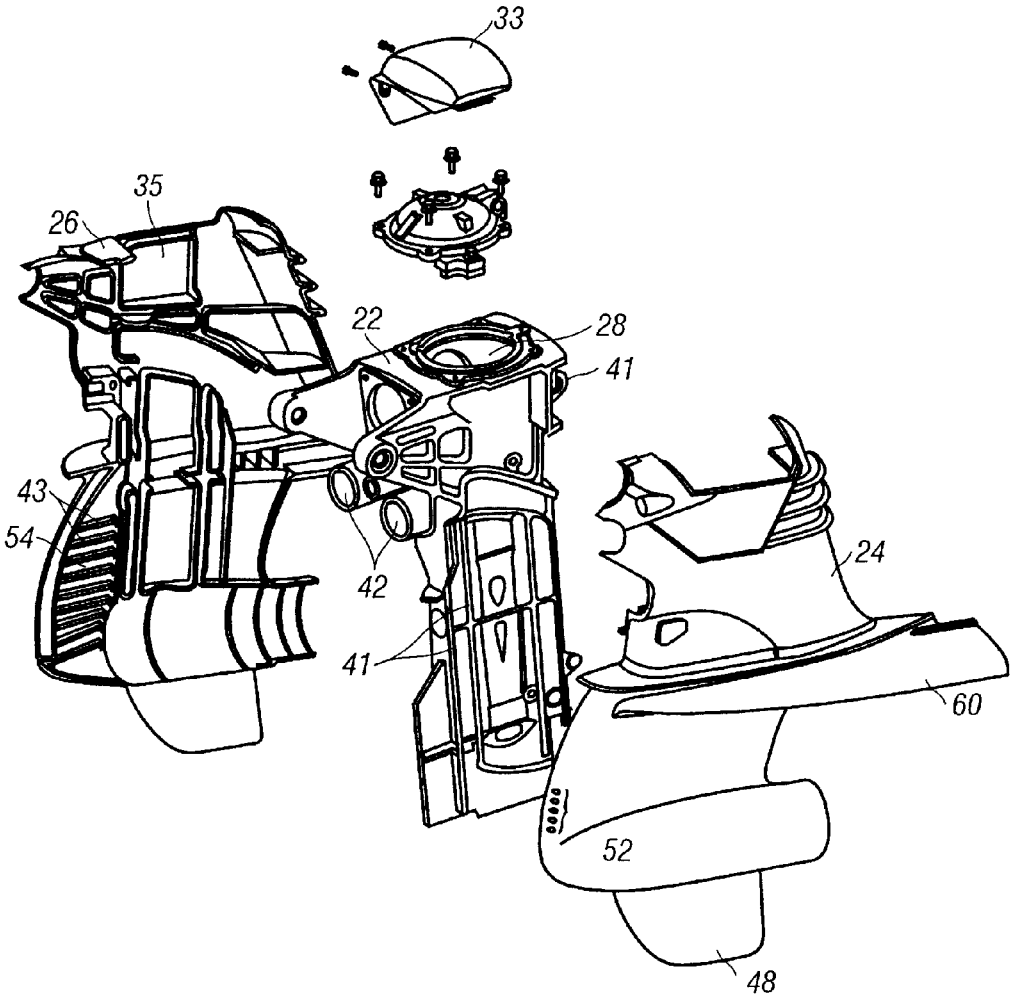
FIG. 2 is an exploded perspective view of the marine drive system.

FIG. 2, an exploded view, shows the drive assembly 20 including, in part, a drive frame or central rigid core 22 and a thin-walled drive housing 31. The drive housing 31 is further composed of a first cowling 24 that covers substantially all of a first side of the drive frame 22 and a second cowling 26 covering substantially all of a second side of the drive frame 22. The first and second sides are located on opposite sides of drive frame 22. Substantially all of one side shall be interpreted as meaning a predominance of one side of drive frame 22, taking into account certain exceptions in the form of windows, apertures, and ports such as an aperture proximate to lower chamber 32 for accommodating propeller 25, another aperture for connecting drive frame 22 to gimbal ring 64, and an aperture for receiving cap 33.

Generally, drive frame 22 provides the drive assembly 20 with a rigid frame or super structure capable of containing and positioning a plurality of gears, bearings and shafts for transferring power from an engine to a propeller, and at times a plurality of propellers, such as two counter-rotating propellers. Further, first and second cowlings 22, 24 provide drive assembly 20 with a hydrodynamic skin that can strengthen drive frame 22. Additionally, the first and second cowlings 22, 24, together with the drive frame 22, provide the drive assembly 20 with a plurality of conduits or channels for transferring raw water, exhaust, and waste water between the engine 21 and the outside environment.

The drive frame 22 supports drive shafts that are used to transfer power from engine 21 to at least one propeller 25. Additionally, drive frame 22 is mechanically coupled between propeller 25 and boat 23 for transferring forces generated by the propeller 25 to boat 23. More specifically, drive frame 22 acts as a moment arm when receiving forces generated by propeller 25. Further, drive frame 22 is sized and constructed of materials that provide rigidity and allow the frame 22 to translate the forces generated by propeller 25 to the boat 23 without any substantial deflection. For instance, drive frame 22 is preferably constructed of aluminum. Drive frame 22, however, can be composed of other materials including, but not limited to, stainless steel, titanium, brass, composites and similarly performing materials. Aluminum is preferred for among other qualities, it rigidity, light weight character, and anticorrosive behavior.

When drive frame 22 is coupled within the drive housing 31 as described in more detail below, drive frame 22 accepts substantially all of the forces generated by the propeller or caused by the propeller and conveys them to the carrying boat 23. The drive housing 31 provides some structural integrity to the drive assembly 20, however, drive housing 31 does not translate any significant forces generated by the propeller to the boat. Instead, this is done substantially alone by the drive frame 22.

Drive frame 22 can have various designs. For instance, one embodiment of drive frame 22 includes an upper chamber 28, a middle chamber 30, and a lower chamber 32. Upper chamber 26 is sized to receive and house a plurality of gears and a clutch assembly for transferring torque from an engine drive shaft 34 coupled to engine 21 to an upright drive shaft 38 that is capable of being positioned within the middle chamber 30. A clutch assembly suitable for use in the present invention is disclosed and described in U.S. Pat. No. 4,397,198, that is hereby expressly incorporated by reference in its entirety. Further, other suitable clutch assemblies can be used without deviating from the scope of the present application.

Middle chamber 30 includes a plurality of bearings that position the upright drive shaft 38 within an interior space of the middle chamber 30, and correctly position the upright drive shaft 38 in relation to engine drive shaft 34 and the propeller drive shaft 40. The lower chamber 32 houses a plurality of bearings that position propeller drive shaft 40. Additionally, lower chamber 32 houses gears capable of rotating propeller drive shaft 40 clockwise or counterclockwise for forward or reverse operation. Lower chamber 32 can be sized to accommodate a single propeller, or a dual propeller configuration that includes counter rotating propellers as is known in the art.

Drive frame 22 is preferably a unitary piece and as previously indicated, constructed from aluminum. Drive frame 22, however, can be composed of any number of pieces. Further, it should be understood by those skilled in the art that drive frame 22 can be further compartmentalized, and drive frame 22 can comprise fewer than the three chambers described above.

Figure 3:
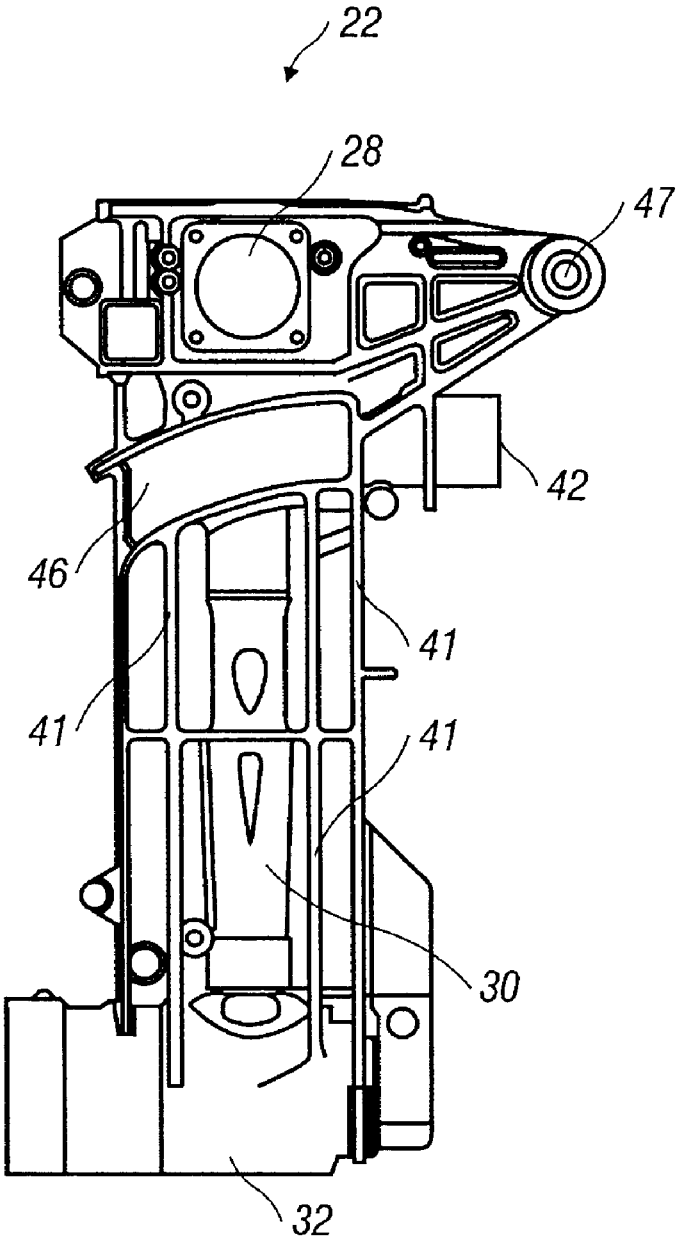
FIG. 3 is a side view of a drive frame of the marine drive system.
Figure 4:
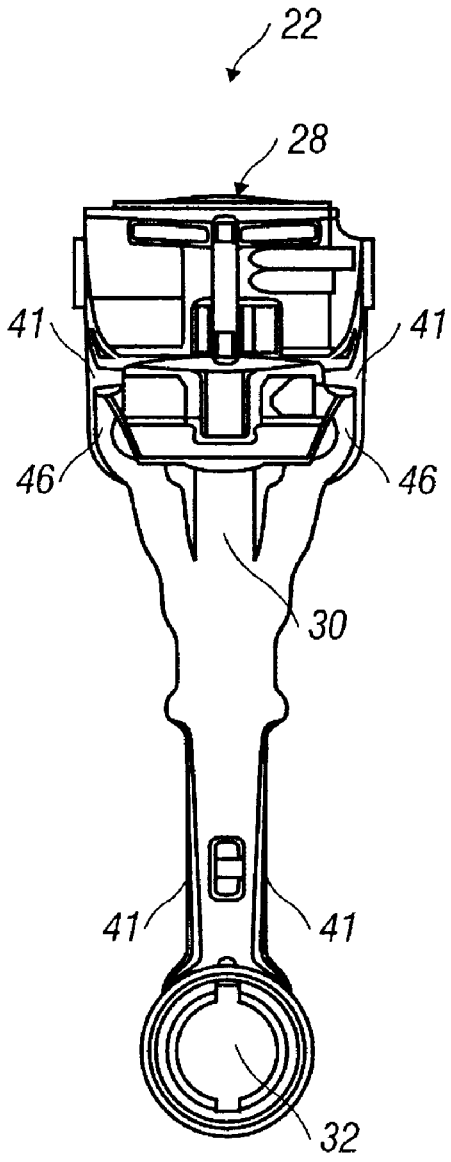
FIG. 4 is a rear view of the drive frame.

As can best be seen in FIGS. 3 and 4, drive frame 22 preferably includes a plurality of ribs 41 protruding generally laterally from the exterior surface of the body of the drive frame 22. Ribs 41 can be formed on drive frame 22, for example, during the frame's 22 manufacture. Among other purposes, ribs 41 are configured to fortify the drive frame 22 against loads experienced as the boat 23 moves through a body of water and as the drive frame 22 is pivotally adjusted in the water while the boat is under power. In addition to providing structural stiffness, ribs 41 may act as a tongue to matingly engage corresponding laterally extending members 43 formed on cowlings 24, 26 as described in greater detail below. Alternatively, ribs 41 can include a groove for engaging corresponding laterally extending members 43 from the cowlings 24, 26.

Drive assembly 20 also preferably includes at least one exhaust inlet 42. In the illustrated embodiment, an exhaust inlet 42 is formed on each side of the drive frame 22. Exhaust inlets 42 are formed as apertures or channels that allow exhaust gasses and waste cooling water to flow from engine 21 and out of the drive assembly 20 through exhaust port 44 and the propeller 25 as is illustrated by the dashed-arrowed line in FIG. 7. Each exhaust inlet 42 is arranged in fluid communication with an exhaust semi-conduit 46. An exhaust semi-conduit 46 is located on an exterior surface at each side of the drive frame 22 and is configured to cooperate with correspondingly formed semi-conduits on first or second cowling 24, 26 to form an exhaust passage. Ultimately, each passage terminates in an exhaust port 44. Exhaust port 44 provides an exit for the exhaust gases produced by the engine 36.

Drive frame 22 can also include a shifting rod chamber that is capable of receiving a shifting rod for actuating shiftable gears located in the lower chamber 32. Further, drive frame 22 can include at least one conduit system for transferring oil from lower chamber 32 to a filter located on the boat 23, and back to lower chamber 32. This system enables the oil to be monitored for water contamination or for the presence of metal shavings. Both of these conditions are indicators of potentially serious and life limiting problems for a marine engine.

Figure 1B:
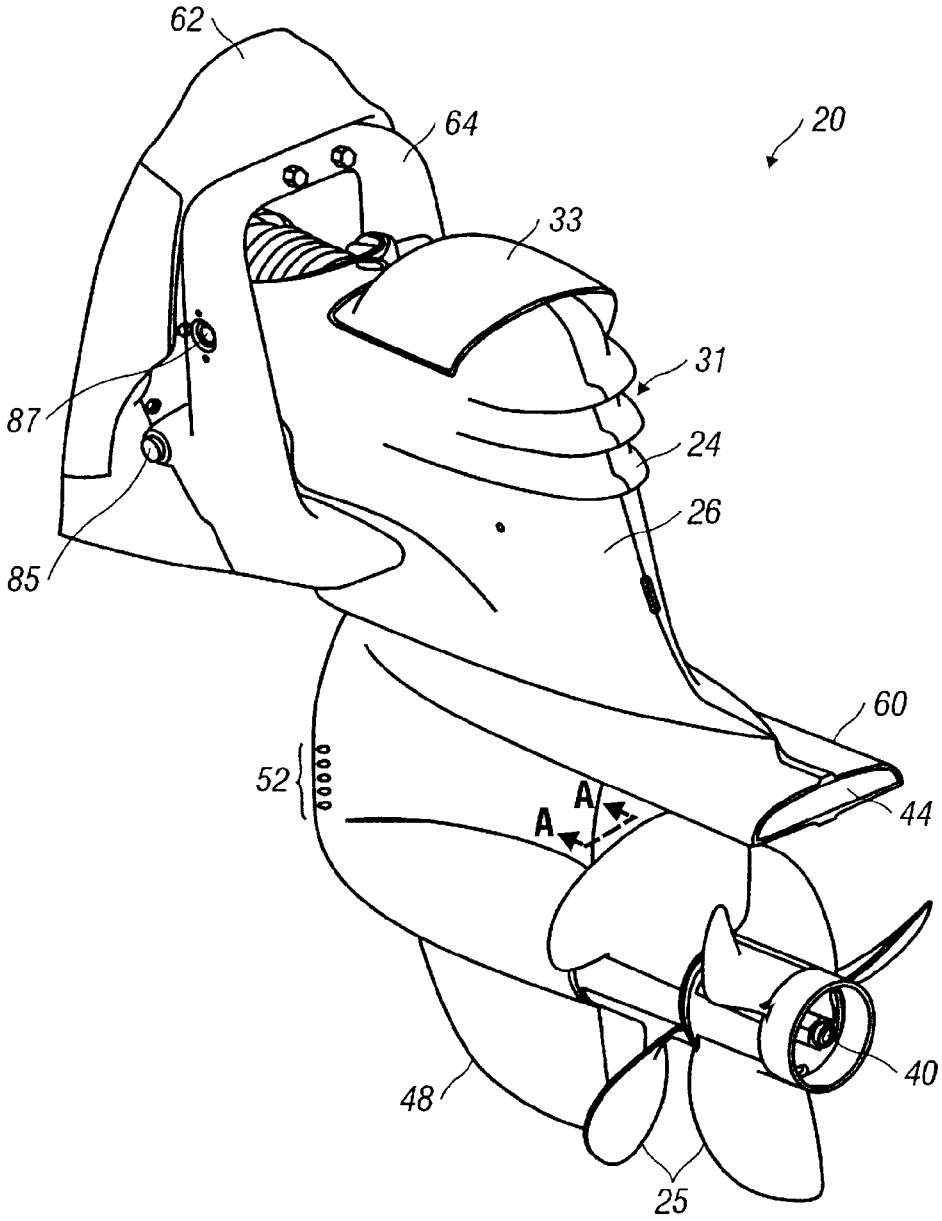
FIG. 1B is a perspective view of the marine drive system.

Drive frame 22 further includes mounting arms 47 configured to be coupled to a mounting assembly on a transom 27 of boat 23. Mounting arms 47 can take the form of posts adapted to be received within receiving bores on the transom 27. Alternatively, mounting arms 47 can include bores from receiving insert posts that form an axle for pivotation as shown in FIG. 3. FIG. 1B shows this pivot connection 87 as it appears from the exterior of the drive assembly 20.

Figure 5:
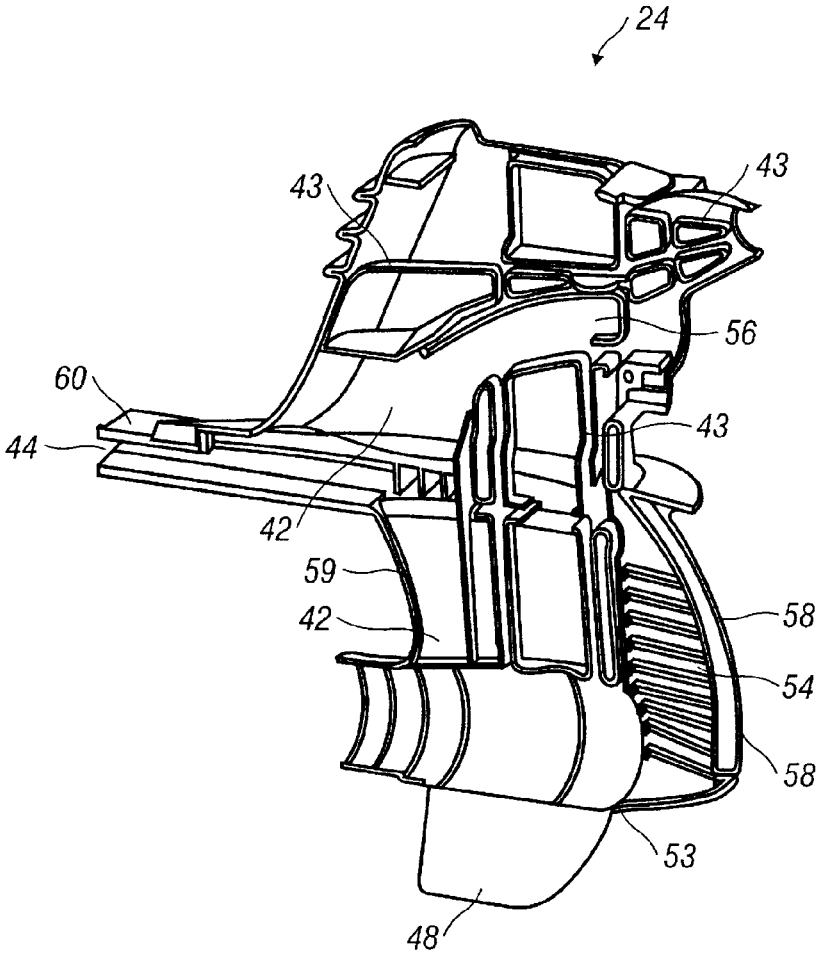
FIG. 5 is a perspective view of an internal surface of a cowling.
Figure 6:
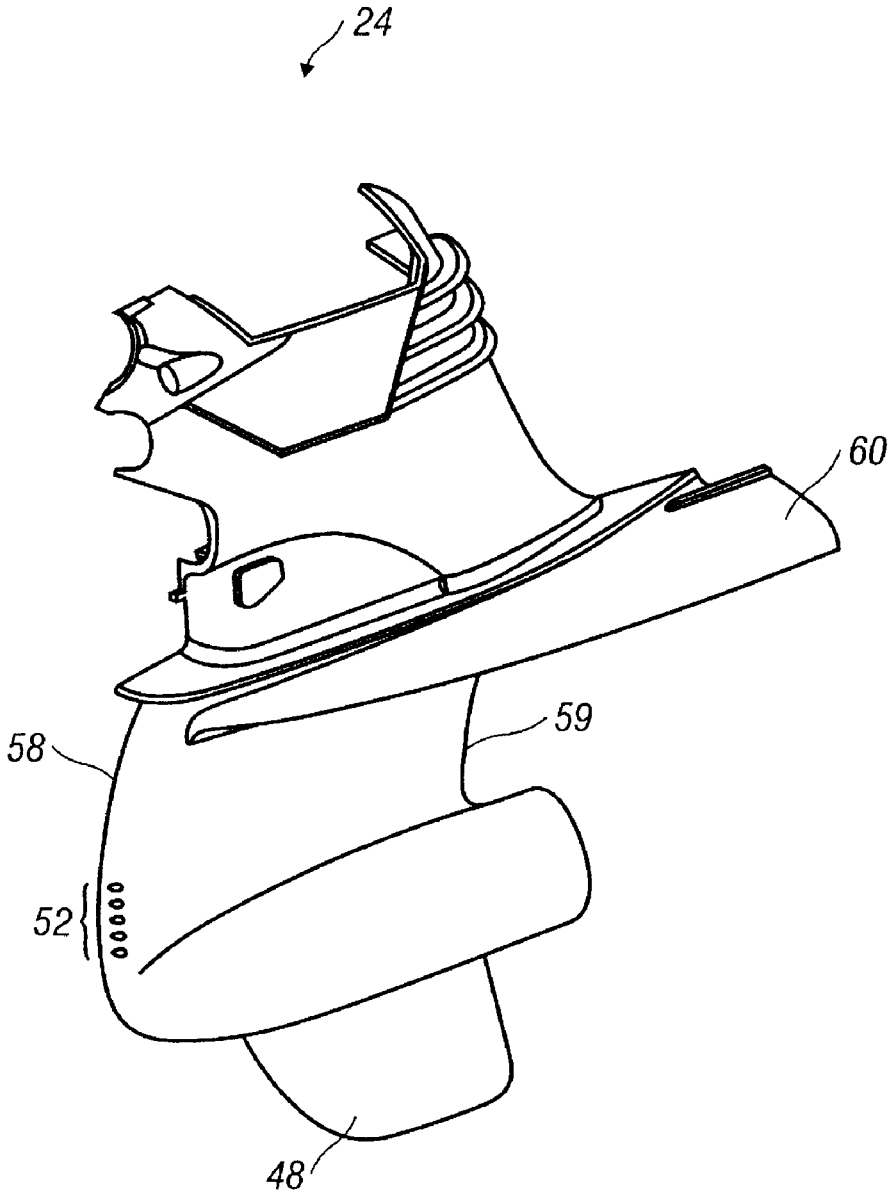
FIG. 6 is a perspective view of an external surface of a cowling.
Figure 7:
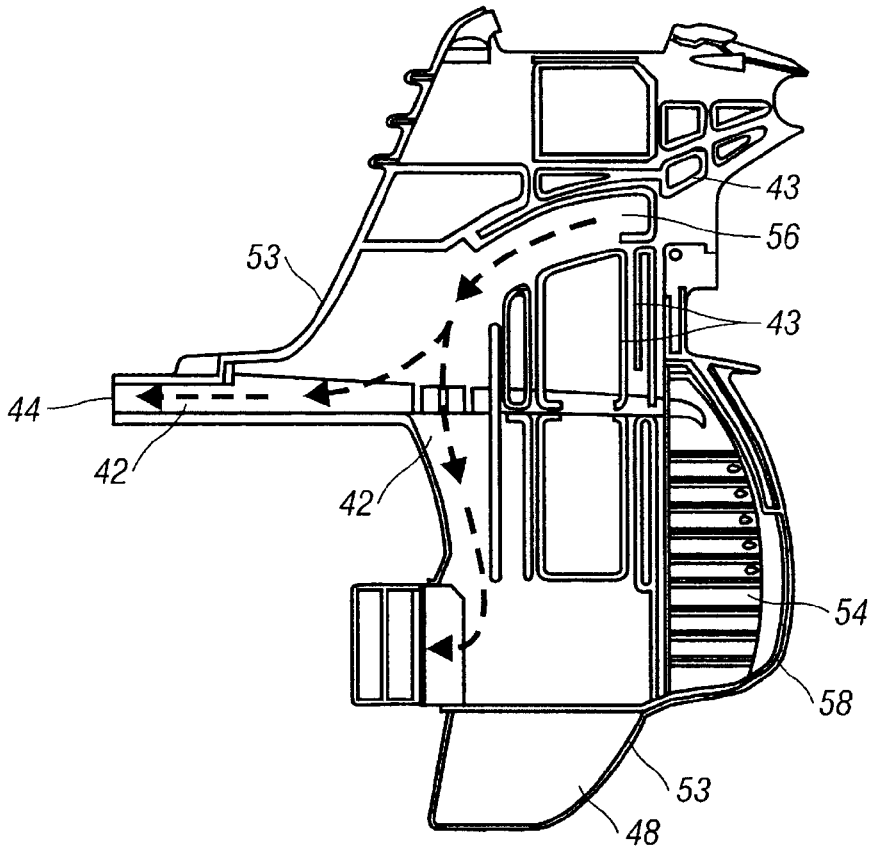
FIG. 7 is an elevational view of the internal surface of a cowling.

Referring again to the drive assembly 20, which in one embodiment includes two cowlings. As described before, first cowling 24 and second cowling 26 provide drive assembly 20 with a hydrodynamic skin surface. Specifically, once constructed, the drive housing 31 has an exterior surface that contacts ambient water in which the boat 23 floats. Generally, first cowling 24 covers the first side of the drive frame 22 and second cowling 26 covers the second side of the drive frame 22. As illustrated in FIGS. 5–7, first cowling 24 is a near mirror image of second cowling 26. However, this invention in not restricted to the cowlings 24, 26 being even near mirror images of each other. For instance, first cowling 24 could cover substantially all of a first side of drive frame 22 and could form a substantial entirety of skeg 48. In such an embodiment, second cowling 26 could cover a substantial portion of a second side of drive frame 22, but not form skeg 48. Rather, second cowling 26 could form an intersection with first cowling 24 at a location proximate to skeg 48. In yet another embodiment, cowlings 24, 26 could join each other on the side of drive frame 22 rather than at front edge 58 and rear edge 59. FIG. 2 shows an asymmetric aspect in the form of a window 35 that is provided in only one of the cowlings 26 that permits access to a shift mechanism for maintenance and repair purposes. It should be appreciated, however, that other designs incorporating the spirit of the invention will be obvious to one of ordinary skill in the art and are not detailed herein, such as drive housing 31 having more than two sections.

For the sake of brevity, first cowling 24 as shown in FIGS. 5 and 6 will be discussed in detail with the understanding that second cowling 26, as illustrated at least in part in FIG. 7, is a substantial mirror image of first cowling 24, but will typically have select different and custom features. As described briefly above, first cowling 24 substantially covers an entire side of drive frame 22 and forms an exterior shell resembling conventional upper and lower units of a drive assembly. First cowling 24 includes skeg portion 48, raw water pickup ports 52, raw water semi-conduit 54, and exhaust semi-conduit 56. Raw water pickup ports 52 are positioned near front edge 58 of the first cowling 24 for receiving water for the engine cooling system. Alternatively, the ports 52 may be advantageously located on the leading edge of the assembly 20. Ports 52 are configured to receive water at both low and high speeds.

Semi-conduits are essentially half of a conduit that are formed at the internal surface of first cowling 24. Semi-conduits can also be referred to as recessed surfaces. Further, a semi-conduit can form more than or less than half of a conduit. These semi-conduit portions 54, 56 are positioned and designed to at least cooperate, and preferably mate with semi-conduit portions formed on the external surface of drive frame 22. Specifically, once first cowling 24 is properly positioned upon drive frame 22, respective semi-conduits form a complete conduit, thereby eliminating the need for other components, such as hoses, to form such conduits. As a result, the number of parts needed to construct drive assembly 20 is reduced, thereby simplifying the design and increasing the durability and reliability of the drive assembly. Further, the reduction in the number of parts also reduces the cost of production.

FIG. 6 shows first cowling 24 further includes a portion for forming half of an anti-cavitation plate 60. The entire anti-cavitation plate 60 is formed with the combination of first cowling 24 and second cowling 26. Anti-cavitation plate 60 begins at front edge 58 of first cowling 24 and extends aft, terminating at and forming exhaust port 44. Exhaust port 44 is placed in fluid communication with an exhaust inlet 42 through an exhaust passage formed by the semi-conduits of one of the cowling 24, 26 and the drive frame 22.

First cowling 24 and second cowling 26 are preferably formed from a composite material, which is a combination of two or more materials that has properties that the constituent materials typically do not have by themselves. It is preferred that the composite material exhibit characteristics of toughness, stiffness, and be suitable for use in applications subject to impacts and rough handling. In a preferred embodiment, the composite is a vinyl ester-based sheet-molding compound. The composite preferably comprises a glass fiber content in the range of less than about seventy percent. In a particularly preferred embodiment, the glass fiber content is about sixty-three percent. The glass fibers are preferably about twenty to thirty millimeters long. In a particularly preferred embodiment, the glass fibers are about 25 millimeters long.

The composite material employed in the preferred embodiment of the present invention offers several advantages over conventionally employed metals. For example, the composite material has a higher tensile strength than aluminum that is normally used to form conventional lower units (344 Mpa vs. 250 Mpa) and a lower density (1.9 specific gravity vs. 2.7 specific gravity for aluminum). Such a reduction in density offers a substantial reduction in the overall weight of the drive assembly 20. In an exemplary application, a weight reduction of approximately forty pounds has been achieved over a comparable conventionally construction drive assembly. This weight reduction is about twenty percent of the weight of drive assembly 20. Moreover, the preferred composite material has a lower modulus of elasticity, which means that for a given stress, the composite material will flex more than aluminum, steel, or other metals. Consequently, the lower modulus of elasticity provides increased resistance to impacts.

This increased resistance to impacts is appreciated especially when the cowlings 24, 26 withstand repeated blows to front edge 58. Specifically, drive assembly 20 has been subjected to a log test that entails driving a boat using a drive assembly 20 for propulsion across a submerged wooden telephone pole having a diameter of about twelve to sixteen inches. In the test, the telephone pole is floating in the water and generally perpendicular to the boat's 23 heading. The boat 23 was driven at speeds of twenty miles per hour, thirty-five miles per hour, and forty-five miles per hour. As the boat crossed the log, the front edge 58 of cowlings 24, 26 collided with the telephone pole. The drive assembly 20 was subjected to multiple collisions with such a telephone pole at each of the speeds identified above. After each collision, drive assembly 20 remained in working condition. Further, drive assembly 20 was closely inspected after each collision and showed no visual signs of performance-compromising damage, such as cracks or stress marks. Instead, only cosmetic damage occurred to the outside surface of cowlings 24, 26 at the local region surrounding the impact point(s) on front edge 58.

The composite material is preferably formed from composite sheets that are, for example, about three millimeters thick and tacky to the touch. Suitable sheets having thicknesses ranging from about two to ten millimeters may be utilized without drastically departing from the spirit of the invention. A molding assembly is used to cut the composite sheets into desired lengths. These lengths of composite material are then placed into a mold which is referred to as the charge pattern. The mold is then subjected to pressure and heat until the cowling is properly molded. The composite is then allowed to cure and set. Using this method, first and second cowlings can be pre-formed with the semi-conduits described above.

As may be appreciated in FIGS. 2, 5 and 7, this composite material allows a plurality of laterally extending members 43 to be formed on cowlings 24 and 26 in a cost-effective manner compared to conventional metal housings or cover portions. Further, the composite material and the design of cowlings 24 and 26 allow raw water intake semi-conduit 54 and exhaust semi-conduit 56 to be formed in the most efficient configuration possible. Specifically, sharp corners that are found in other stern drive assemblies, which provide a haven for salt to accumulate and significantly reduce the life of an stern drive, are eliminated. Furthermore, the configuration of the semi-conduits 54 and 56 reduces the friction flow loss associated with less efficient systems having abrupt paths for containing raw cooling water and exhaust gases and water. In an alternative embodiment, cowlings 24, 26 can be composed of composite materials other than the composite material described above. Further, cowlings 24, 26 can be made of materials such as, but not limited to, aluminum, titanium, brass, or galvanized steel.

Figure 8:
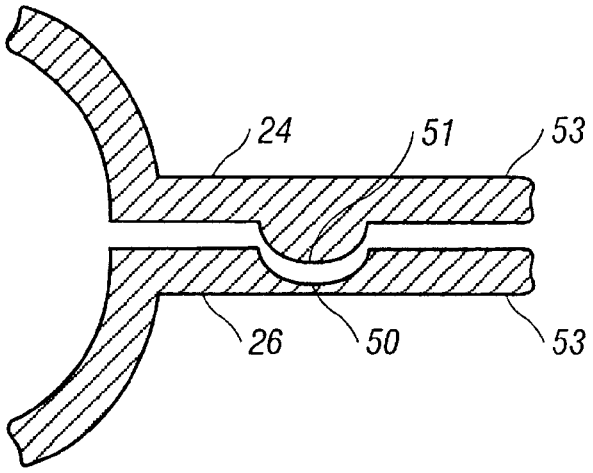
FIG. 8 is a cross-sectional view taken along section line A—A as shown in FIG. 1B.

Cowlings 24, 26 can include a cowling connection system for connecting cowlings 24, 26 to each other. Preferably, the cowling connection system includes a tongue and groove system for locking the cowlings 24, 26 together. Specifically, first cowling 24 can include a groove 50 for receiving a tongue 51, and second cowling 26 can include tongue 51 capable of fitting within the groove 50, or vice versa. This tongue and groove system can be located at the perimeter 53 of the cowlings 24, 26 and provides cowlings 24, 26 with a reinforced connection means. The tongue and groove system can be composed of a single groove located at the perimeter 53, or it can include multiple grooves 50 for receiving tongues 51. Further, grooves 50 can have rounded cross-section, as shown in FIG. 8, or the cross-section can be in the shape of a rectangle, a triangle, a trapezoid, or any other configuration allowing first cowling 24 to mate with second cowling 26. Only one tongue and groove is illustrated; it should be appreciated, however, that multiple tongues and mating grooves may be employed without departing from the spirit of this aspect of the invention.

In another embodiment, the cowling connection system can be composed of a plurality of snap fittings. More particularly, the perimeter 53 of the inside surfaces of cowlings 24, 26 can include snap fittings forming an L orj shape that lock together after being pressed against each other.

The cowling connection system, as described above, can also be used for mating drive frame 22 to cowlings 24, 26. Specifically, laterally extending members 43 on cowlings 24, 26 can each have a groove 50 for receiving tongues 51 formed by ribs 41 on drive frame 22, or vice versa. It is preferable that the tongues 51 and grooves 50 be sized to accommodate a layer of adhesive between each. Alternatively, laterally extending members 43 and ribs 41 can include a snap fitting connection system as described above or any other suitable connection system.

In a preferred embodiment, drive frame 22 and cowlings 24, 26 are bonded together using an adhesive, such as epoxy or other suitable material. This epoxy can be used to bond together tongues 51 and grooves 50 formed in drive frame 22 and grooves 50 formed in cowlings 24, 26. Preferably, the adhesive produces a permanent bond between first cowling 24 and second cowling 26 and between drive frame 22 and cowlings 24, 26. In this embodiment, cowlings 24, and 26 are not readily removed from drive assembly 20 after being assembled. Rather, a monolithic structure is formed once cowlings 24, 26 have been attached to drive frame 22 and to each other.

These bonds and the addition of the adhesive increase the overall structural integrity of the drive frame 22. In addition, by bonding cowlings 24, 26 to drive frame 22, cowlings 24, 26 are able to transmit hydrodynamic steering loads to drive frame 22 and gimbal ring 64, which increases the overall efficiency of the system. It is also preferred that first and second cowlings 24, 26 are also bonded together using an adhesive applied to the perimeter 53 of each cover portion. If needed, bolts or other suitable mechanisms could be used in addition to the adhesive but are not necessary. Alternatively, the adhesive could be substituted with mechanical fasteners, such as, but not limited to, screws, nuts and bolts.

Bonding cowlings 24, 26 together and to drive frame 22 provides significant manufacturing advantageous. For instance, it is no longer necessary to use bolts to couple a lower unit to an upper unit. Instead, cowlings 24, 26 can be quickly coupled to each other and to drive frame 22 using an adhesive, as described above. Further, the bonding process can be completed with robotic machines, rather than human labor. As a result, significant reductions in labor costs are realized by using the bonding process. In addition, the need to pressure test an upper unit, a lower unit, and the seal between each has been eliminated because the upper and lower units have been eliminated. Instead, only a single test is need to test the drive assembly after cowlings 24, 26 have been coupled to drive frame 22.

FIG. 1B shows that drive frame 22 is pivotably coupled to a gimbal ring 64 at axis 87. Pivotation of drive frame 22 is controlled by a single hydraulic trim cylinder 78, as described in detail below and pivotably connected upon axle 85 through first aperture 74 and at second aperture 76 on ears connected to the gimbal ring 64. Gimbal ring 64 is pivotably mounted to a shield assembly 62 that allows the gimbal ring 64, together with drive frame 22 and attached cowlings 24, 26, to rotate about a generally vertical axis for steering purposes. Shield assembly 62 can be coupled to transom 27 of a boat 23 and typically provides at least water tight seals for the engine drive shaft 34 and an exhaust conduit 65 across the transom 27. Further, shield assembly 62 can be made of the composite material described above. However, shield assembly 62 can be composed of materials including, but not limited to aluminum, stainless steel, titanium and other suitable composite materials.

Figure 10:
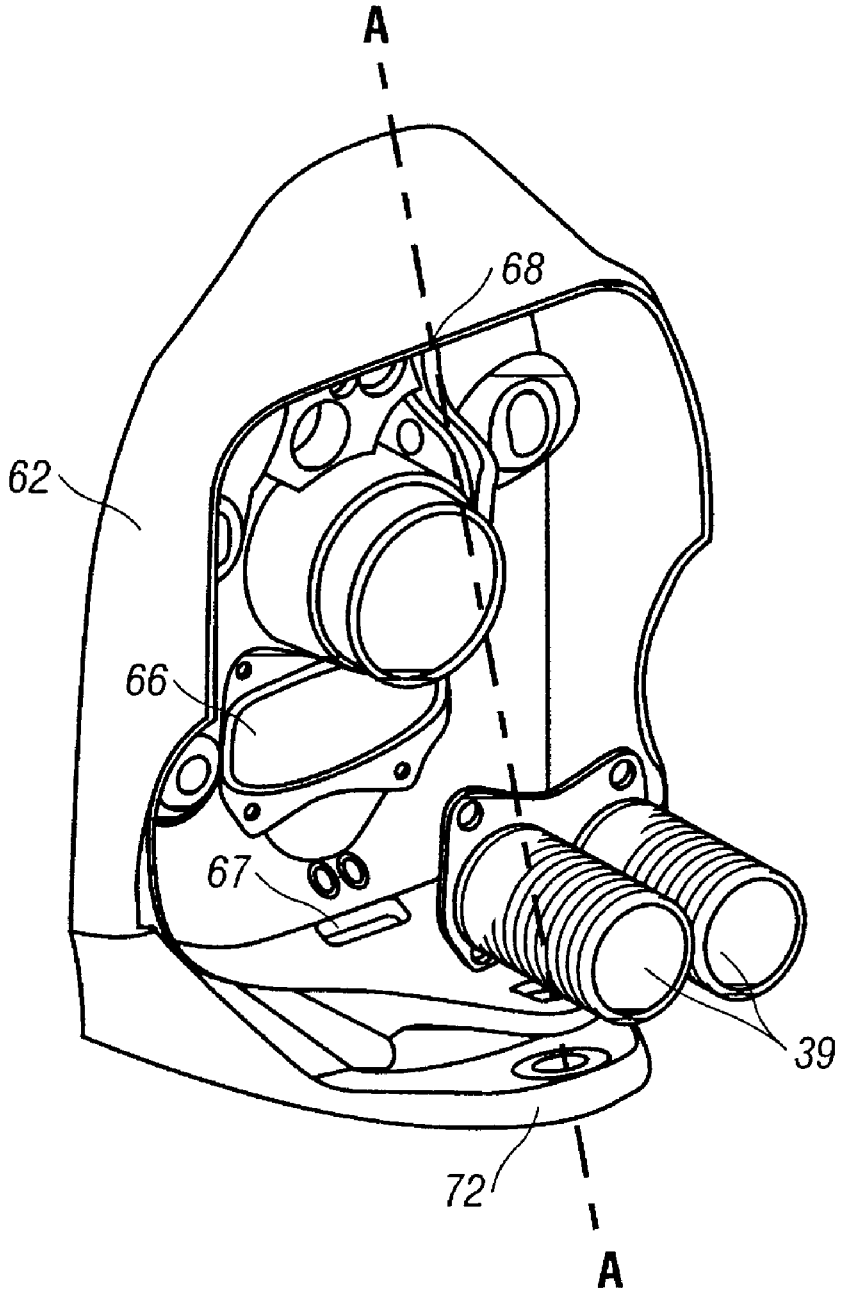
FIG. 10 is a perspective view of a shield assembly.

Referring to FIG. 10, shield assembly 62 also includes an exhaust water outlet 67 that is preferably in fluid flow communication with exhaust pipe 66. As is well known in the art, the exhaust pipe 66 extends from engine 21 in fluid flow communication with the engine cooling system so that both exhaust gases and exhaust cooling water flow together through exhaust pipe 66. As the cooling water flows through exhaust pipe 66 and enters exhaust passage 42, a majority of the cooling water is diverted through exhaust water outlet 67. The exhaust gases and any remaining exhaust cooling water are passed through exhaust inlet 42 and thereafter through the exhaust passages formed between cowlings 24, 26 and drive frame 22 that ultimately discharge through an exhaust port 44 and/or a propeller assembly 25. Exhaust water outlet 67 opens either to the atmosphere or under the water in which the boat 23 is floating. In this fashion, the spent cooling water can be returned to the body of water in a simple and inexpensive manner.

Figure 11:
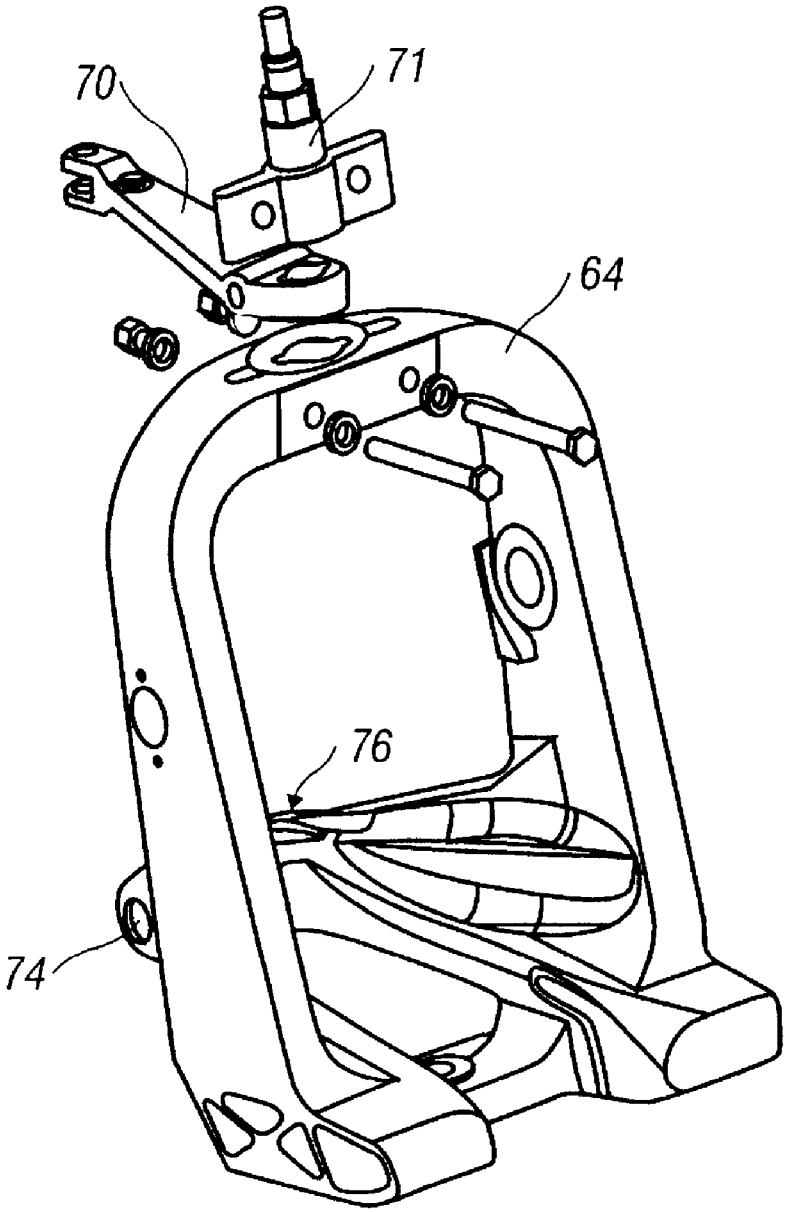
FIG. 11 is a perspective view of a gimbal ring assembly.

Gimbal ring 64 is coupled to shield assembly 62 for pivotal movement about axis A as represented in FIG. 10 so that the drive assembly 20 can be rotated to turn the boat 23. Gimbal ring 64 can be coupled to an upper portion 68 of shield assembly 62 via a steering shaft 70 and key 71 as illustrated in FIG. 11. In addition, gimbal ring 64 can be coupled to a lower portion 72 of shield assembly 62 using a pin or other suitable mechanisms. Gimbal ring 64 can be formed of the composite material described above. Alternatively, gimbal ring 64 can be composed of materials including, but not limited to aluminum, stainless steel, titanium and other composite materials.

Shield assembly 62 and gimbal ring 64 each contain a centrally located opening. These openings are sized to receive and provide passage for at least a drive shaft, an exhaust system, a raw cooling water system, and a shifting rod. Further, both shield assembly 62 and gimbal ring 64 can provided passage for other parts of drive assembly 22.

Figure 9A:
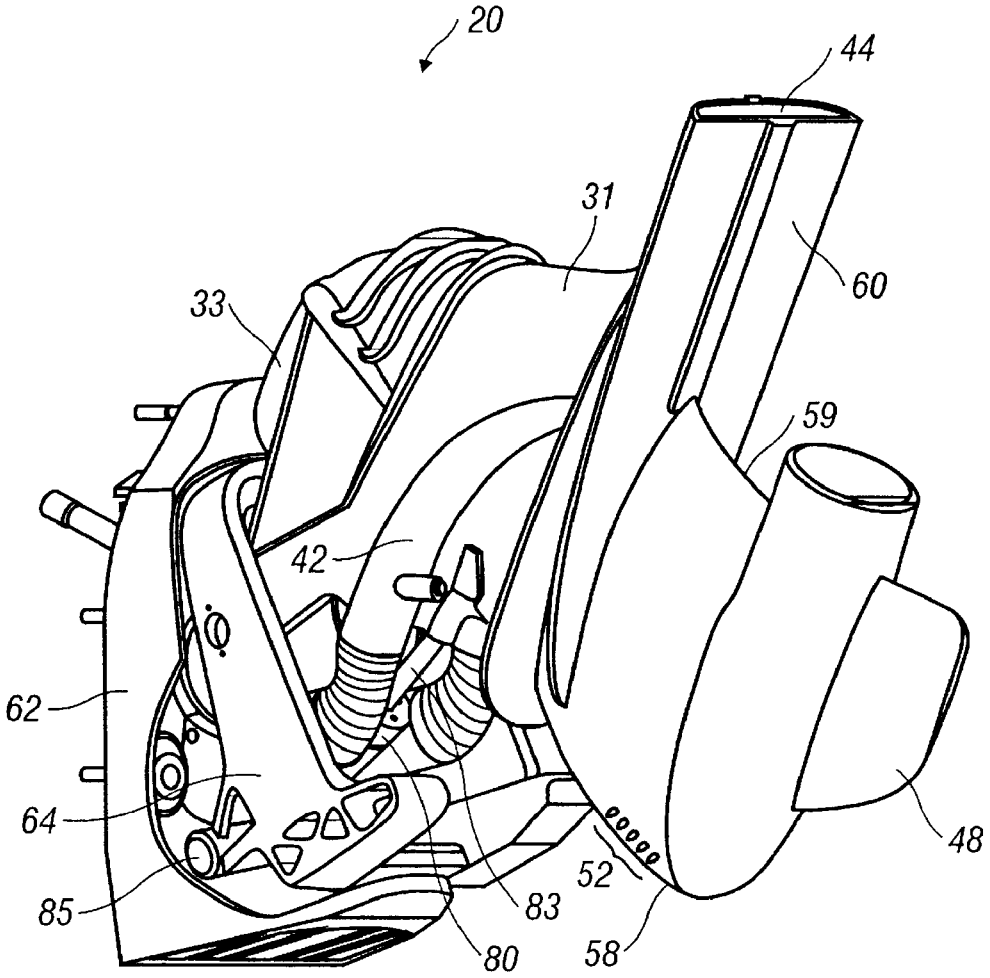
FIG. 9A is a perspective view of the marine drive system in a tilt-up position showing a single trim cylinder.
Figure 9B:
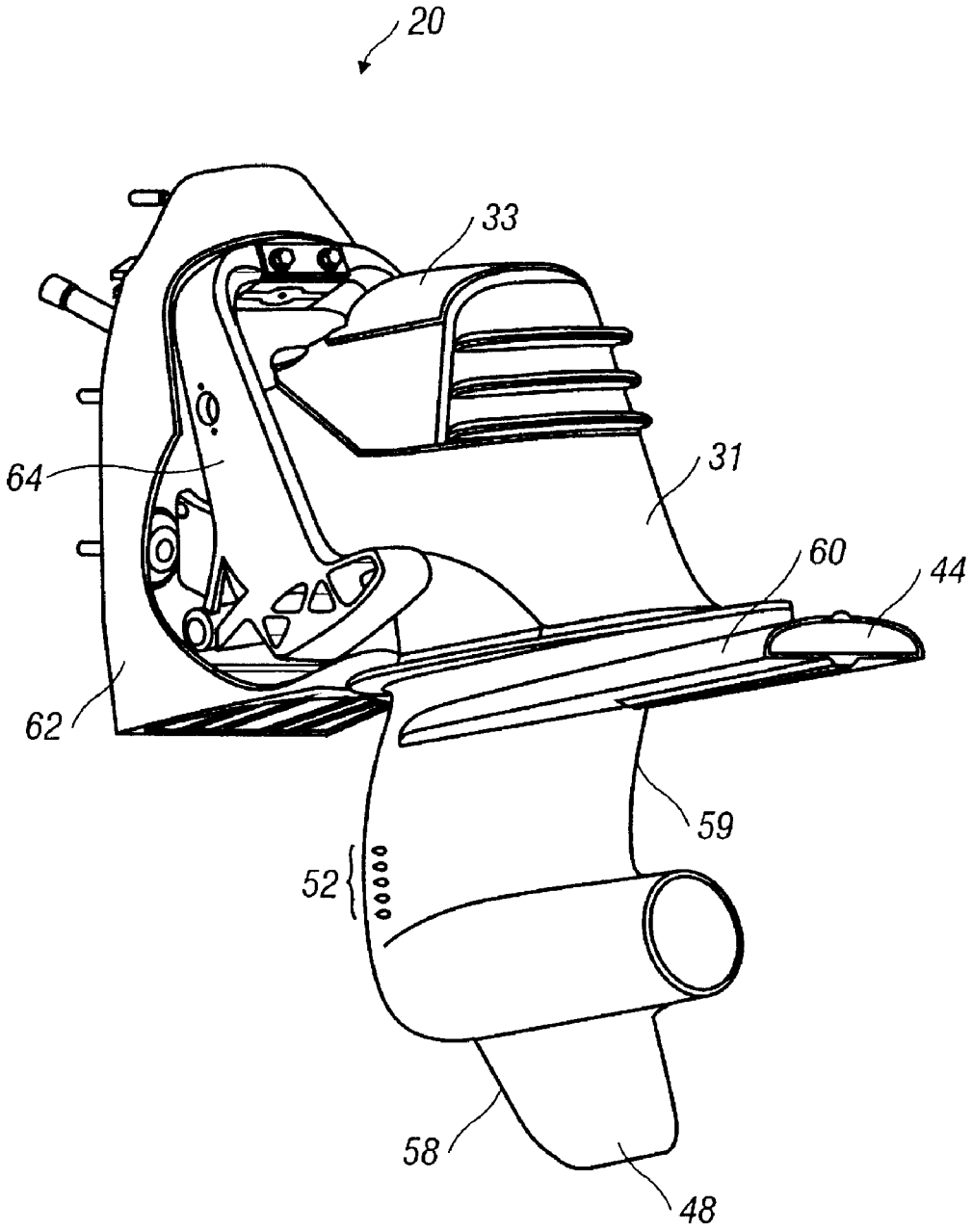
FIG. 9B is a perspective view of the marine drive system in a tilt-down position.
Figure 12:
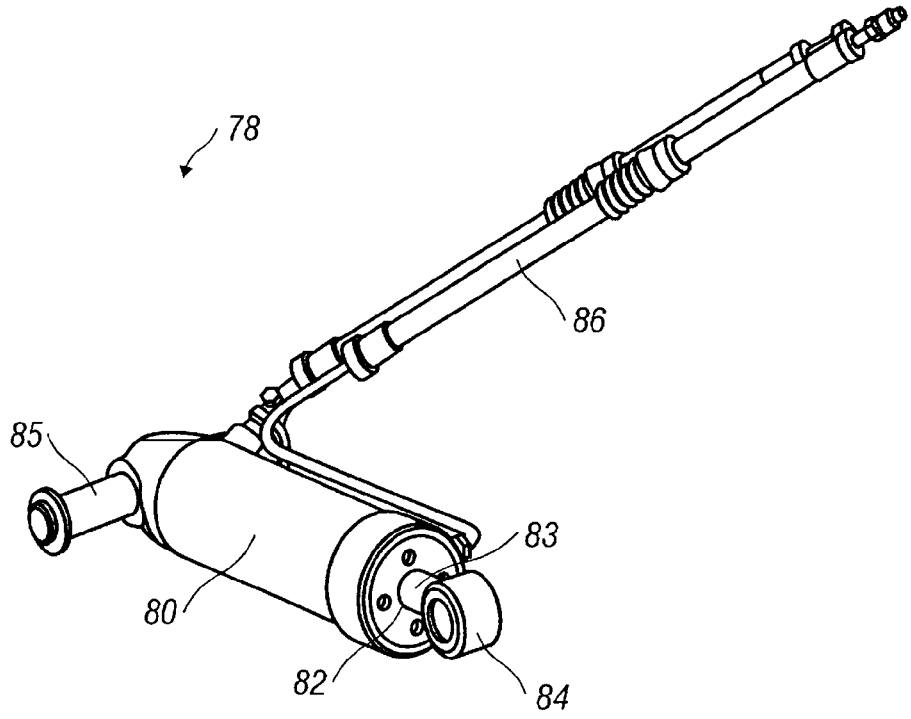
FIG. 12 is a perspective view of a single trim cylinder assembly.

As shown in FIGS. 9A and 9B, an hydraulic trim assembly 78 exemplarily illustrated in FIG. 12 controls the pivot position of drive frame 22 and cowlings 24, 26. Specifically, hydraulic trim cylinder 78 enables drive frame 22 and cowlings 24, 26 to be pivoted for trim and tilt purposes through a range of about minus five degrees, as represented in FIG. 9B, to about plus sixty degrees, as represented in FIG. 9A, relative to a vertical axis. In addition, the lower limit of minus five degrees can vary, either up or down, without departing from the scope of this invention. Likewise, the upper limit of sixty degrees can vary, either up or down, without departing from the scope of this invention.

Now referring to FIG. 12, hydraulic trim assembly 78 includes a cylinder 80 having a bore 82, a piston (not shown) slideably housed in cylinder 80 and a piston rod 83 having a first end coupled to the piston and a second opposite or drive end 84 extending from the cylinder 80 and pivotably coupled to drive frame 22. For instance, the drive end 84 of piston rod 82 can be pivotably coupled to drive frame 22 via a connecting member, such as a pin, dowel, or other suitable mechanism extending through both the opposite end of piston rod 82 and drive frame 22. Drive frame 22 preferably has defined therein a bore for also accepting such a connecting member. In this configuration, the tilt and trim of drive assembly 20 can be controlled from the helm of boat 23. For instance, hydraulic trim assembly 78 can be actuated using a remote control unit typically positioned near the steering wheel of boat 23 and composed of a toggle switch. Actuating hydraulic trim assembly 78 either causes piston rod 82 to run in or out, depending on which direction the toggle switch is depressed. While the piston rod runs in or out, drive frame 22 pivots about a generally horizontal axis formed by the axle 87. This rotation is generally referred to as adjusting the tilt or the trim of the drive frame 22. As discussed above, trim refers to the rotational range of between about minus five degrees and about plus fifteen degrees relative to a vertical axis that a drive assembly can move through, and tilt refers to the rotational range of between about plus fifteen degrees and about plus sixty degrees relative to a vertical axis. Adjusting the trim angle changes the performance of the boat by changing, among other things, the height of the bow while the boat is on plane and the amount of cavitation present at propeller 25. Running piston rod 82 all the way out is referred to as a tilt-up position as shown in FIG. 9A and running the piston rod 82 all the way into the cylinder 80 is referred to as a tilt-down position as represented in FIG. 9B. Generally, the tilt-down position is used while running the boat 23. Further, the trim-up position is generally used when the boat is in shallow water or the bow of the boat is relatively heavy. The tilt-up position is most typically used for trailering the boat. The single hydraulic trim assembly 78 can move drive frame 22 through both the tilt and trim ranges discussed above, and the single trim assembly 78 preferably moves drive frame through this range at the same rate of speed. In a preferred embodiment of the present invention, a single hydraulic trim assembly 78 is employed. The single hydraulic trim assembly 78 dictates the use of dual exhaust passages 42, which in a preferred embodiment requires a substantially Y-shaped manifold ahead of the cylinder 80. The exhaust system is composed of exhaust pipe 66 that is coupled to engine 21. Exhaust pipe 66 receives both exhaust water and gases. Exhaust pipe 66 is coupled to shield assembly 62. At shield assembly 62, the exhaust system is split into two parallel exhaust conduits 39 using a Y-manifold or adapter. Flexible hoses make up the exhaust conduits 39 between shield assembly 62 and drive frame 22. Each exhaust conduit 39 is fluidly connected to an exhaust passage extending through drive frame 22 and ultimately form the exhaust passage that is in fluid communication with exhaust port 44. The Y-manifold or connecter diverts the exhaust around single hydraulic trim assembly 78. Additionally, this exhaust configuration presents less resistance to fluid flow than conventionally plumbed exhaust systems. Thus, less back pressure develops and engine 21 is able to run more efficiently.

In addition, it is preferable that hydraulic trim assembly 78 be coupled to drive frame 22 at a point substantially midway along the length of drive frame 22 for reduced stress on the parts, to provide a greater moment arm for lifting the drive frame 22, and to alleviate the need for using two hydraulic trim cylinders. It should be apparent to one having ordinary skill in the art, however, that hydraulic trim assembly 78 may be mounted at any point along the length of drive frame 22. Further, hydraulic trim assembly 78is mounted in its substantial entirety within gimbal ring 64, thereby eliminating the water spray conventionally caused by mounting hydraulic trim assemblies outside of gimbal ring 64.

As may be appreciated from FIG. 9A, the hydraulic trim assembly can be coupled between the drive frame 22 and the gimbal ring 64. Further, in this configuration, hydraulic trim assembly 78 is at least partially covered by gimbal ring 64 and shield assembly 62, as may be appreciated from FIG. 9B. In addition, hydraulic trim assembly 78 is at least partially covered by drive frame 22 and drive housing 31"s two cowlings 24, 26. As a result, hydraulic trim assembly 78 is shielded, at least partially from spray water during use. Specifically, while the hydraulic trim cylinder 78 can be exposed to ambient water while boat 23 is at rest or is off plane, hydraulic trim cylinder 78 is not in contact with ambient water as the boat 23 is running on plane. This, increases the life of hydraulic trim cylinder 78 and reduces the likelihood of failure. Further, maintenance of the hydraulic trim cylinder 78 is not required as often, thus, producing a cost savings for a boat owner.

In addition, as represented in FIG. 9A, hydraulic trim assembly 78 is positioned at a centerline of drive frame 22 and within a plane also containing the vertical axis about which gimbal ring 64 rotates. This axis is identified as axis A as shown in FIG. 10. Further, hydraulic trim assembly 78 passes through axis A. Positioning hydraulic trim assembly 78 in this fashion reduces stress on assembly 78, drive frame 22 and gimbal ring 64.

Drive system 20 transfers torque or momentum between engine 21 and propeller 25. Further, drive system 20 can change the direction of propeller 25 for steering boat 23 and can change the angular position of the propeller 25 relative to a vertical axis. As described in detail above and depicted in FIG. 1, drive system 20 can advantageously be coupled with an inboard/outboard engine. However, the invention is not limited to use only with an inboard/outboard engine. Rather, drive system 20 can be used in cooperation with an outboard engine as well. It is recognized that some modification to the drive system 20 would be required to couple it with an outboard engine; however, the spirit of the drive frame 22 and cowlings 24, 26 combination invention would remain substantially unchanged.

For example, an outboard engine could receive a drive frame 22 that is adapted to couple directly to the power head of an outboard engine or couple to a support member that is proximate to the power head. In this configuration, drive frame 22 would resemble the drive frame portrayed in FIGS. 3 and 4; however, upper chamber 28 would be removed because drive assembly would accept a generally vertical engine drive shaft, rather than a generally horizontal drive shaft from an inboard/outboard engine. Further, drive frame 22 would be capable of receiving a generally vertical drive shaft and include a lower chamber 32 for containing the gears, bearings and propeller drive shaft necessary to convert the rotational motion of the generally vertical drive shaft to a propeller drive shaft positioned generally perpendicular to the vertical drive shaft. Also, cowlings 24, 26 could maintain the same general exterior shape as the cowlings depicted in FIGS. 5 and 6; however, top portions of cowlings 24, 26 would have to be configured to be received by an engine cowling covering the outboard engine. Also, raw water semi-conduit 54 and exhaust semi-conduit 56 would function in a similar manner as described above, except that their route would differ in order to connect to an outboard engine that is positioned above drive assembly 20 rather than to its side, as is the case with an inboard/outboard engine.

The system 20 described herein includes numerous advantages when compared with conventional systems. For instance, the design of the cowlings 24 and 26 and the drive frame 22 allow for cowlings 24, 26 to be formed of a composite material that is not susceptible to corrosion. Further, the system 20 includes fewer parts than conventional systems, thereby yielding a more reliable and efficient system. In addition, the system 20 is lighter than conventional system which results in better fuel economy. The cowlings 24 and 26 also have less hydrodynamic drag than conventional systems. Moreover, the system 20 is more maneuverable than previous systems. The curvaceous design of the passages in the assembly 20 promote fluid flow by their avoidance of sharp turns and dead-space corners. This design is not only enabled by the clam-shell design of the cowlings 24,26 about the central frame member 22, but also by the elimination of the traditional die-cast housings that have composed the lower and upper end units of stern drive systems. Through the molding process enabled by the use of composites, curvaceous channels are easily formed merely by the provision of such features as channel-defining ribs or vanes that establish walls, or parts of walls that delimit such channels. Preferably, the cowling features cooperate with corresponding features on the core member to form such functional features as exhaust and cooling water paths or passages. As but one example, because of the freedom these configurations allow, the exhaust system of the present invention is more efficient than conventional designs because the amount of back pressure generated within the system while it is operating is minimized. Additionally, the drive assembly 20 produces less unwanted water spray than was caused in conventional systems utilizing two hydraulic trim cylinders, each located along side the stern drive assembly.

The foregoing is provided for purposes of illustrating, explaining, and describing embodiments of this invention. Modifications and adaptations to these embodiments will be apparent to those skilled in the art and may be made without departing from the scope or spirit of this invention or the following claims.

What is claimed is:

1. A stern drive assembly configured for utilization on an inboard/outboard boat, said stern drive assembly comprising:

a central rigid core configured at an upper portion to be coupled to the stern of a carrying boat and also configured at a lower portion thereof to accept a boat-moving force generated by a water propulsion unit coupled to said lower portion;

a thin-walled housing configured to be secured about a predominance of said central rigid core, said housing having an outer surface that establishes an exterior of said stern drive assembly and an inner surface directed generally toward said central rigid core; and a portion of an exterior surface of said central rigid core configured to cooperate with a corresponding portion of said inner surface of said thin-walled housing, said two portions, when in cooperative orientation one with the other, forming a functional feature for the stern drive assembly.

2. The stern drive assembly as recited in claim 1, further comprising:

said thin-walled housing being generally spaced apart from said central rigid core thereby forming a working space therebetween, said working space configured to accommodate location of said functional feature therein.

3. The stern drive assembly as recited in claim 1, further comprising:

said thin-walled housing being generally spaced apart from said central rigid core thereby forming a working space therebetween, said working space being maintained by at least one spacing rib abuttingly positioned between said thin-walled housing and said central rigid core.

4. The stern drive assembly as recited in claim 1, further comprising:

said thin-walled housing being generally spaced apart from said central rigid core thereby forming a working space therebetween, said working space being maintained by a plurality of spacing ribs positioned between said thin-walled housing and said central rigid core.

5. The stern drive assembly as recited in claim 4, further comprising:

at least one of said plurality of spacing ribs being transversely oriented to at least one other spacing rib of said plurality of spacing ribs, said transverse orientation fortifying at least a portion of said thin-walled housing against flexure.

6. The stern drive assembly as recited in claim 1, further comprising:

said functional feature being a fluid flow passage configured to carry fluids through said stern drive assembly during operation upon a carrying boat.

7. The stern drive assembly as recited in claim 6, further comprising:

said fluid flow passage being at least partially curvaceously shaped for facilitating fluid flow therethrough during operation upon a carrying boat.

8. The stern drive assembly as recited in claim 6, further comprising:

said fluid flow passage being configured as an exhaust channel.

9. The stern drive assembly as recited in claim 6, further comprising:

said fluid flow passage being configured as a coolant water channel.

10. The stern drive assembly as recited in claim 1, further comprising:

said functional feature being formed at least partially by substantially transversely extending rib from said thin-walled housing.

11. The stern drive assembly as recited in claim 10, further comprising:

said substantially transversely extending rib from said thin-walled housing being at least partially curvaceously configured and extending substantially perpendicularly from said inner surface of said thin-walled housing.

12. The stern drive assembly as recited in claim 1, further comprising:

said functional feature being formed at least partially by substantially transversely extending rib from said central rigid core.

13. The stern drive assembly as recited in claim 12, further comprising:

said substantially transversely extending rib from said central rigid core being at least partially curvaceously configured and extending substantially perpendicularly from said exterior surface of said central rigid core.

14. The stern drive assembly as recited in claim 13, further comprising:

said functional feature being formed at least partially by substantially transversely extending rib from said thin-walled housing.

15. The stern drive assembly as recited in claim 14, further comprising:

said substantially transversely extending rib from said thin-walled housing being at least partially curvaceously configured and extending substantially perpendicularly from said inner surface of said thin-walled housing.

16. The stern drive assembly as recited in claim 1, further comprising:

said thin-walled housing being formed from at least two clam-shell style cowlings configured for mating engagement, one with the others, along perimeter portions thereof.

17. The stern drive assembly as recited in claim 1, further comprising:

said thin-walled housing being formed from at least partially from impact resistant composite material configured as at least two clam-shell style cowlings.

18. The stern drive assembly as recited in claim 17, further comprising:

at least two clam-shell style cowlings being cemented together and forming a predominance of an exterior presentation of said stern drive assembly.

19. The stern drive assembly as recited in claim 17, further comprising:

at least two clam-shell style cowlings being cemented together and forming a substantial entirety of an exterior presentation of said stern drive assembly.

20. The stern drive assembly as recited in claim 17, further comprising:

at least two clam-shell style cowlings being cemented together and cemented to said central rigid core for substantially permanent fixation together.

21. The stern drive assembly as recited in claim 1, further comprising:

said central rigid core being unitarily constructed thereby forming a monolithic member between said upper and lower portions thereof.

22. The stern drive assembly as recited in claim 21, further comprising:

said unitarily constructed central rigid core being manufactured from deflection resistant aluminum.

23. The stern drive assembly as recited in claim 1, further comprising:

said thin-walled housing being constructed from composite material and having an average thickness ranging from about 2 mm to about 10 mm, said thickness being selected based on desired performance characteristics including durability and rigidity.

24. The stern drive assembly as recited in claim 1, further comprising:

said thin-walled housing being constructed from composite material and having an average thickness of about 3 mm, said thickness being selected based on desired performance characteristics including durability and rigidity.

25. A stern drive assembly configured for utilization on an inboard/outboard boat, said stern drive assembly comprising:

a central rigid core configured at an upper portion to be coupled to the stern of a carrying boat and also configured at a lower portion thereof to accept a boat-moving force generated by a water propulsion unit coupled to said lower portion;

a thin-walled housing configured to be secured about a predominance of said central rigid core, said housing having an outer surface that establishes an exterior of said stern drive assembly and an inner surface directed generally toward said central rigid core; and a functional feature of the stern drive assembly being formed at least partially by a portion of one of said central rigid core and said thin-walled housing, and said functional feature being located substantially between said central rigid core and said thin-walled housing.

26. A drive assembly for use in a boat, comprising:

a drive frame mechanically coupled between a propeller and the boat for transferring forces generated by the propeller to the boat;

a drive housing for enclosing the drive frame and having an exterior surface that contacts ambient water; and the drive housing being formed from at least a first cowling and a second cowling and the drive housing including a first aperture for use in coupling the propeller to a drive shaft and a second aperture for use in coupling the drive shaft to an engine.

27. The drive assembly as set forth in claim 26, wherein the first cowling is configured to cover a substantial entirety of a first side of the drive frame and the second cowling is configured to cover a substantial entirety of a second side of the drive frame, the first side and the second side being positioned on opposite sides of the drive frame.

28. The drive assembly as set forth in claim 26, wherein the first and second cowlings comprise a composite material.

29. The drive assembly as set forth in claim 28, wherein the composite material comprises a glass fiber content less than about 70 percent.

30. The drive assembly as set forth in claim 29, wherein the composite material comprises a glass fiber content of about 63 percent.

31. The drive assembly as set forth in claim 26, further comprising an adhesive that secures the first cowling to the second cowling.

32. The drive assembly as set forth in claim 31, wherein each of the first and second cowlings of the drive housing are secured to the drive frame with the adhesive.

33. The drive assembly as set forth in claim 31, wherein the adhesive is an epoxy.

34. The drive assembly as set forth in claim 26, wherein:

the first cowling of the drive housing having a first recessed surface, the first recessed surface being formed on an interior surface of the first cowling;

the drive frame having a second recessed surface; and the first recessed surface of the first cowling of the drive housing configured to matingly engage the second recessed surface of the drive frame to form a first fluid passage within an interior of the drive housing.

35. The drive assembly as set forth in claim 34, wherein:

the first cowling of the drive housing having a third recessed surface;

the second cowling of the drive housing having a fourth recessed surface;

the third recessed surface of the first cowling configured to matingly engage the fourth recessed surface of the second cowling to form a second fluid passage within the drive housing; and the second fluid passage being coupled to the first fluid passage.

36. The drive assembly as set forth in claim 34, wherein:

the second cowling of the drive housing having a third recessed surface;

the drive frame having a fourth recessed surface; and the third recessed surface of the second cowling of the drive housing configured to matingly engage the fourth recessed surface of the drive frame to form a second fluid passage within an interior of the drive housing.

37. The drive assembly as set forth in claim 34, wherein the first and second recessed surfaces form an exhaust passage for the engine.

38. The drive assembly as set forth in claim 26, wherein:

the first cowling of the drive housing has a first recessed surface, the first recessed surface being formed on an interior surface of the first cowling;

the second cowling of the drive housing has a second recessed surface;

the first recessed surface mating of the first cowling mating with the second recessed surface of the second cowling to form a fluid passage within an interior of the drive housing.

39. The drive assembly as set forth in claim 38, wherein the first and second recessed surfaces form an exhaust passage.

40. The drive assembly as set forth in claim 38, wherein the first and second recessed surfaces form a water passage.

41. The drive assembly as set forth in claim 26, wherein the drive frame is formed as a unitary molded structure.

42. The drive assembly as set forth in claim 26, further comprising:

the propeller, the drive shaft, and a gear assembly positioned within the second aperture of the housing for coupling the drive shaft to the propeller.

43. The drive assembly as set forth in claim 38, further comprising:

an engine capable of being secured to the boat and of generating torque; and a mounting assembly for securing the drive housing to the boat.

44. The drive assembly as set forth in claim 43, wherein the mounting assembly comprises a shield assembly for being secured to the boat, the shield assembly being made of a composite material.

45. The drive assembly as set forth in claim 26, wherein the drive frame comprises an external surface having a plurality of ribs integrally formed thereon.

46. The drive assembly as set forth in claim 45, wherein the first cowling comprises a plurality of laterally extending members integrally formed on an internal surface of the first cowling and configured to engage at least one of the plurality of ribs formed on the drive frame, and the second cowling comprises a plurality of laterally extending members integrally formed on an internal surface of the second cowling and configured to engage at least one of the plurality of ribs formed on the drive frame.

47. The drive assembly as set forth in claim 26, further comprising a means for coupling first cowling to the second cowling at a perimeter portion of each.

48. The drive assembly as set forth in claim 47, wherein the means for coupling the first and second cowling comprises a groove formed at the perimeter of the first cowling for coupling the first cowling to the second cowling and a tongue formed at the perimeter of the second cowling for receiving the groove of the first cowling.

49. The drive assembly as set forth in claim 47, wherein the means for coupling the first and second cowling comprises a tongue formed at the perimeter of the first cowling for coupling the first cowling to the second cowling and a groove formed at the perimeter of the second cowling for receiving the tongue of the first cowling.

* * * * *